US005588775A

United States Patent [19]

Hagenah

[11] Patent Number: 5,588,775

[45] **Date of Patent: *Dec. 31, 1996**

[54] PAVING STONE SET AND PROCESS AND DEVICE FOR THE MANUFACTURE THEREOF

[75] Inventor: Gerhard Hagenah, Worpswede, Germany

[73] Assignee: SF-Kooperation GmbH Beton-Konzepte, Bermen, Germany

[ * ] Notice: The term of this patent shall not extend beyond the expiration date of Pat. No. 5,486,066.

[21] Appl. No.: 556,289

[22] Filed: Sep. 29, 1995

Related U.S. Application Data

[63] Continuation of Ser. No. 244,103, filed as PCT/EP92/02670 Nov. 20, 1992, Pat. No. 5,486,066.

[30] Foreign Application Priority Data

Nov. 23, 1991 [DE] Germany ..... 41 38 564.0

[51] Int. Cl.[6] ..... E01C 11/16

[52] U.S. Cl. ..... 404/45; 264/260

[58] Field of Search ..... 404/42, 43, 45; 425/111, 121, 126.1; 264/260

[56] References Cited

U.S. PATENT DOCUMENTS

| | | |
|---|---|---|
| 1,592,591 | 7/1926 | Amele . |
| 4,098,562 | 7/1978 | Levin . |
| 4,168,924 | 9/1979 | Draper et al. . |

FOREIGN PATENT DOCUMENTS

| | | |
|---|---|---|
| 4364 | 10/1979 | European Pat. Off. . |
| 259735 | 4/1990 | European Pat. Off. . |
| 7206680 | 2/1972 | Germany . |
| 2147649 | 5/1972 | Germany . |
| 2752545 | 6/1978 | Germany . |
| 150772 | 9/1981 | Germany . |
| 3200184 | 7/1983 | Germany . |
| 3038843 | 11/1991 | Germany . |
| 6803753 | 9/1969 | Netherlands . |

*Primary Examiner*—William P. Neuder
*Attorney, Agent, or Firm*—Sughrue, Mion, Zinn, Macpeak & Seas

[57] ABSTRACT

1. Paving stone set and process and device for the manufacture thereof.

2.1. In the case of lawn-paving blocks formed from paving stones (10) spaced at a considerable distance apart, these are joined together, against relative displacements, by a holding grid (11) embedded in the paving stones (10) and comprising tension-resistant strands. The said holding grid allows the transfer of traction forces and hence the reciprocal safeguarding of the paving stones (10) within a paving stone set held together by the holding grid (11).

2.2. The manufacture of the paving stone sets is effected in a concrete stone mold which is conventional in its principle. A flask (19) disposed on a molding plate (28) and a drawing sheet (29) is divided in the horizontal plane (33), creating a top part-flask (34) and a bottom part-flask (35). The holding grid (11) is clamped between the two part-flasks during pouring of the concrete. Following the completion of a paving stone set, the bottom part-flask (35) is withdrawn from the concrete stone mold. Demolding can now be carried out in the usual manner.

3 Claims, 6 Drawing Sheets

PAVING STONE SET AND PROCESS AND DEVICE FOR THE MANUFACTURE THEREOF

Figure 1:
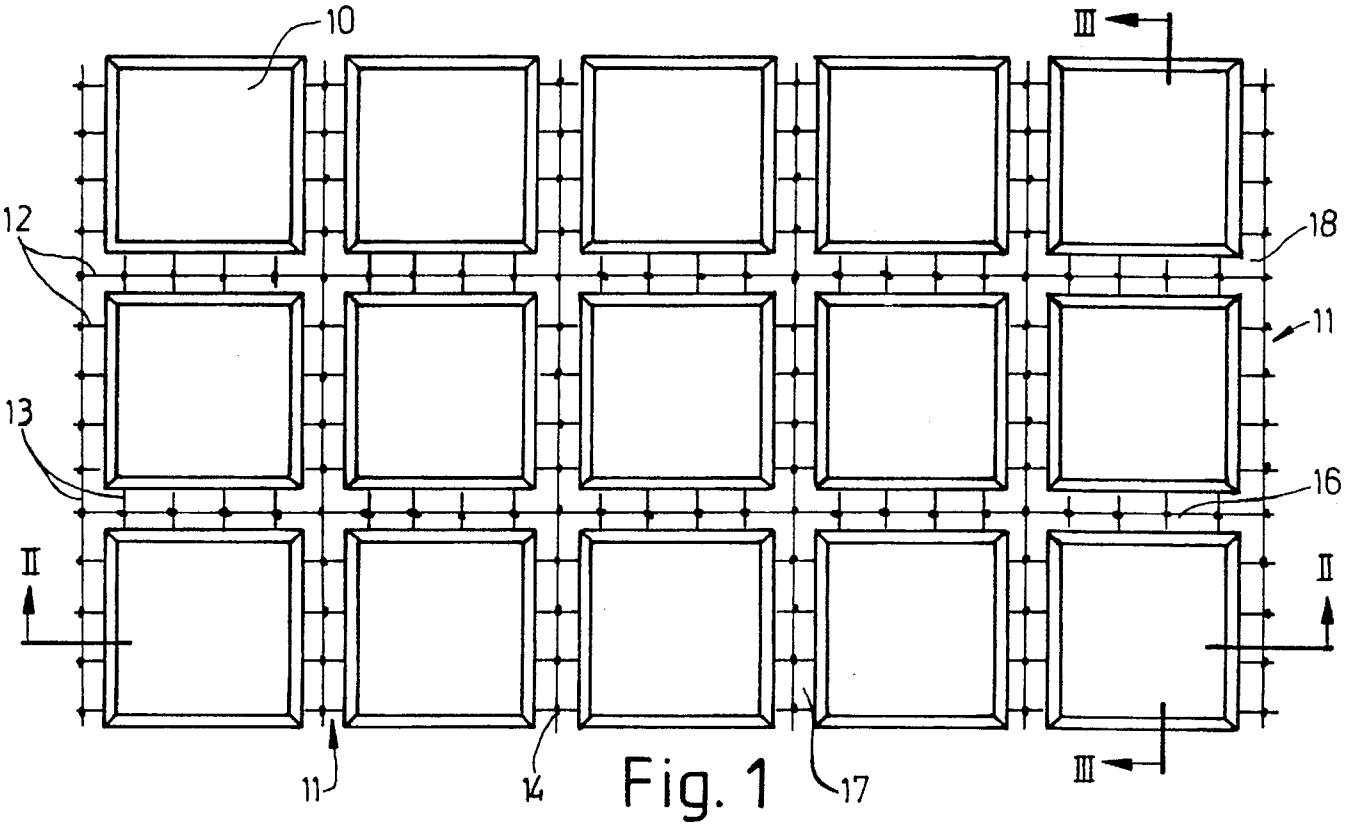

This is a continuation of application Ser. No. 08/244,103, filed as PCT/EP92/02670 Nov. 20, 1992, now U.S. Pat. No. 5,486,066.

DESCRIPTION

The invention relates to a paving stone set for lawn paving made up of concrete paving stones, which are spaced apart, creating wide longitudinal and transverse gaps suitable for plant growth, and are secured by holding members against displacement. The invention further relates to a process and a device for the manufacture of paving stone sets.

Paving blocks, which allow plant growth within gaps between the paving stones, are gaining increasingly in importance. In order to ensure the load-bearing capacity of the so-called "lawn paving blocks" in respect of stationary and—to a limited extent—rolling traffic, the paving stones need to be secured against displacement. For this purpose, spacers have hitherto been disposed in the gaps, by means of which spacers the adjacent paving stones are mutually supported. In the case of the lawn paving according to EP-A-259 735, the paving stones are mutually supported by spacers which, after a certain time, perish in the ground.

The laying of paving blocks of this type is complex. Moreover, the spacers have to be produced and kept handy as separate elements of the paving block.

The object of the invention is to propose, for the design of a lawn paving block and its production, measures which represent a simplification compared to the previous solutions and which ensure moreover, in a simple manner, the long-term securement of the paving stones of the installed paving block.

In order to achieve this object, the lawn paving comprises paving stone inserts, the concrete paving stones of which are joined together by a holding grid consisting of tension-resistant and non-perishable elastic material, especially of synthetic material, which holding grid, in the region of the longitudinal gaps and transverse gaps, lies continuously exposed in a section corresponding to the width of the said gaps.

A paving stone set respectively comprises a group of simultaneously produced paving stones, which, in their manufacture, are joined together to form a unit by a holding grid embedded in the concrete. The holding grid comprises longitudinal strands and transverse strands, which are capable of absorbing tensile loads. The paving stones of the lawn paving are consequently secured, in terms of their relative position to one another, by members which are capable of bearing a tensile load. In the region of the longitudinal gaps and transverse gaps, no further connecting or supporting members for the paving stones are disposed.

The holding grid is configured such that the plant growth in the otherwise continuously exposed longitudinal gaps and transverse gaps is not impaired. The distances between the longitudinal strands and transverse strands are also chosen according to the invention such that, in the production of the paving stones, the fresh concrete is able to pass through openings or meshes in the holding grid. The spacing between the strands measures, for this purpose, 2 cm to 5 cm, preferably around 3 cm.

According to the invention, the holding grid is fully embedded in concrete with an adequate covering of concrete. The holding grid preferably extends at a distance from a bottom side of the paving stones, which corresponds to approximately one-third of the height of the said paving stones.

As a result of this arrangement of the holding grid, special measures are necessary in the production of the paving stone sets. Manufacture is intended to be effected industrially in a conventional stone-molding machine. This is equipped with a concrete mold, which is known in principle. Forming part of this is a molding plate, on which the concrete stones are molded and remain until fully hardened. Also forming part of the concrete mold is a frame-like flask having die cavities which are open at top and bottom and are limited by longitudinal walls and transverse walls. Finally, pressure rams are provided, which enter into the die cavities from above in order to compact the concrete. Furthermore, the concrete mold usually contains a drawing sheet, which is disposed between the flask and the molding plate.

A thus configured concrete mold is equipped, according to the invention, with a flask which is divided in height, namely in a plane running at a distance from the base (molding plate), and consequently comprises a top part-flask and a bottom part-flask. The two part-flasks together in each case form the die cavities. The holding grid is disposed between the part-flasks and is clamped or fixed between them.

The bottom part-frame is specially configured, namely in such a way that, following the production of the concrete stones of a paving stone set, the bottom part-flask can be withdrawn, in a certain direction, from the region of the concrete mold. The bottom part-flask therefore exhibits transverse walls running exclusively in the transverse direction or in the direction of the drawing motion.

Figure 2:
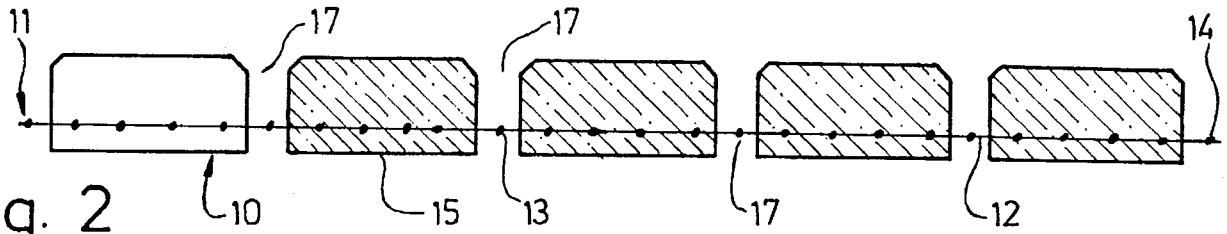
Figure 3:
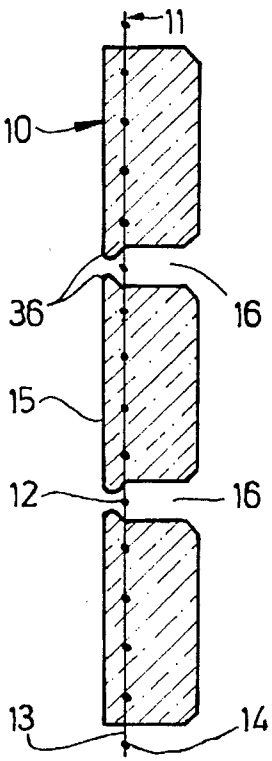
Figure 4:
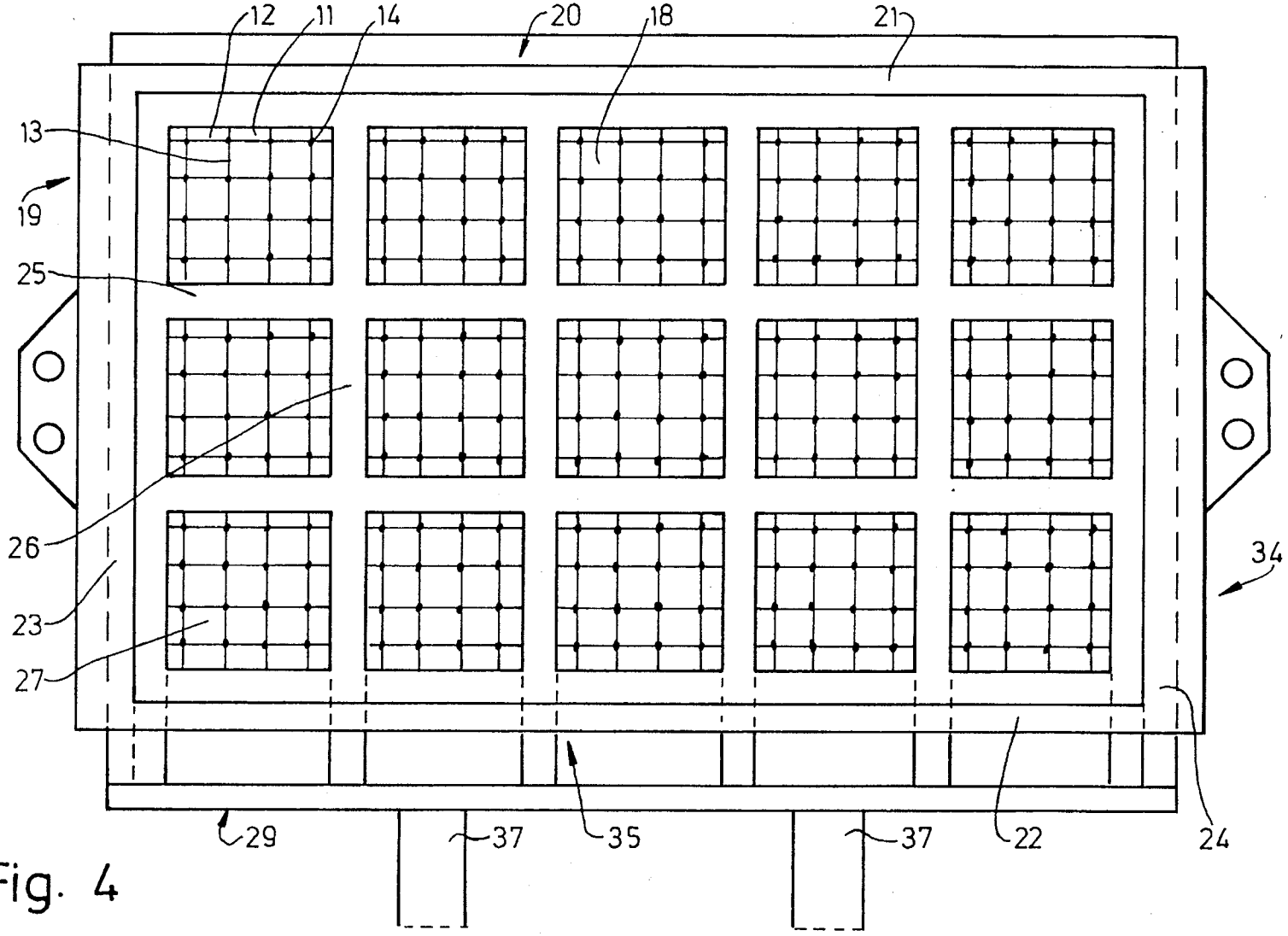
Figure 5:
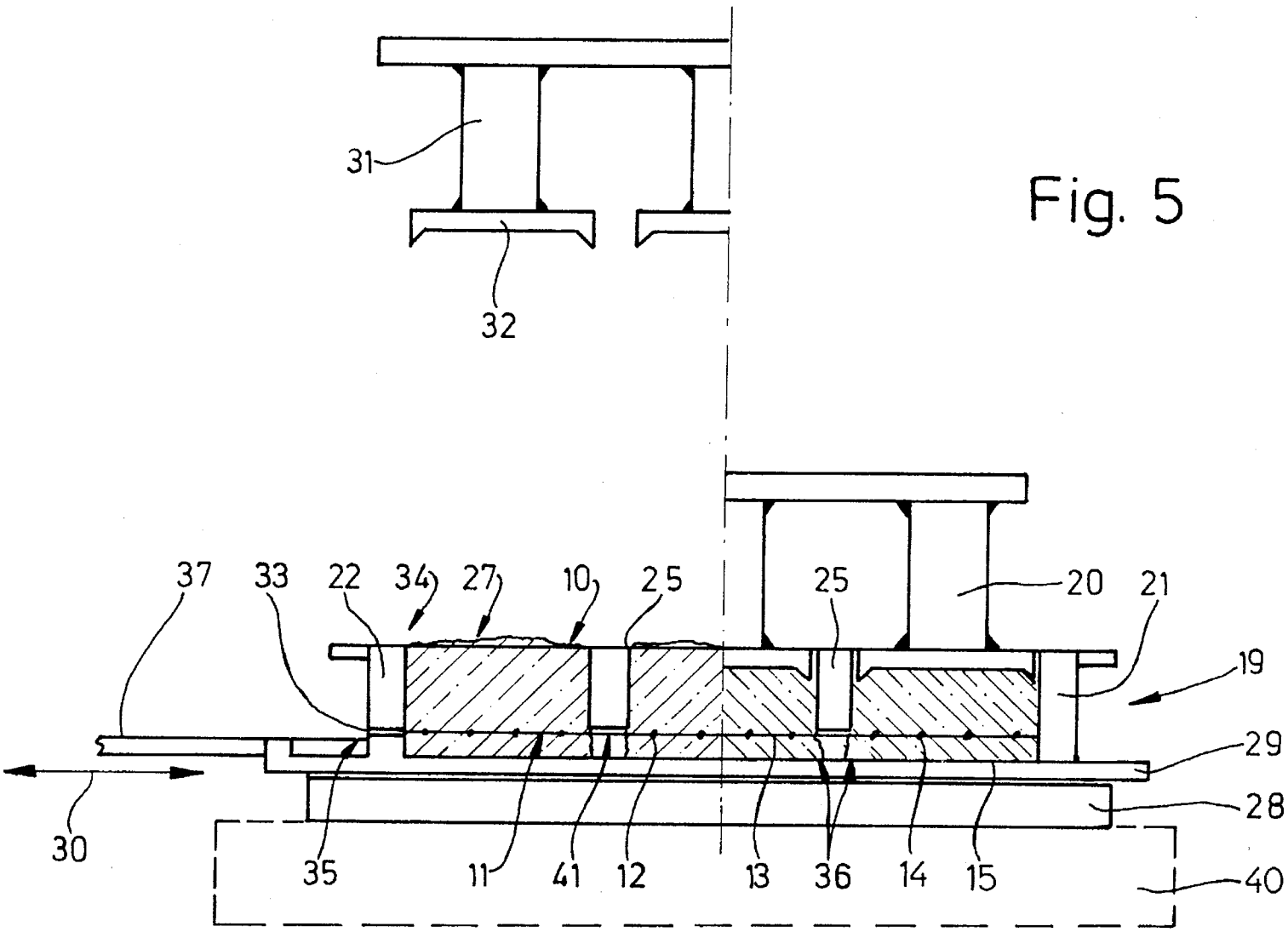
Figure 6:
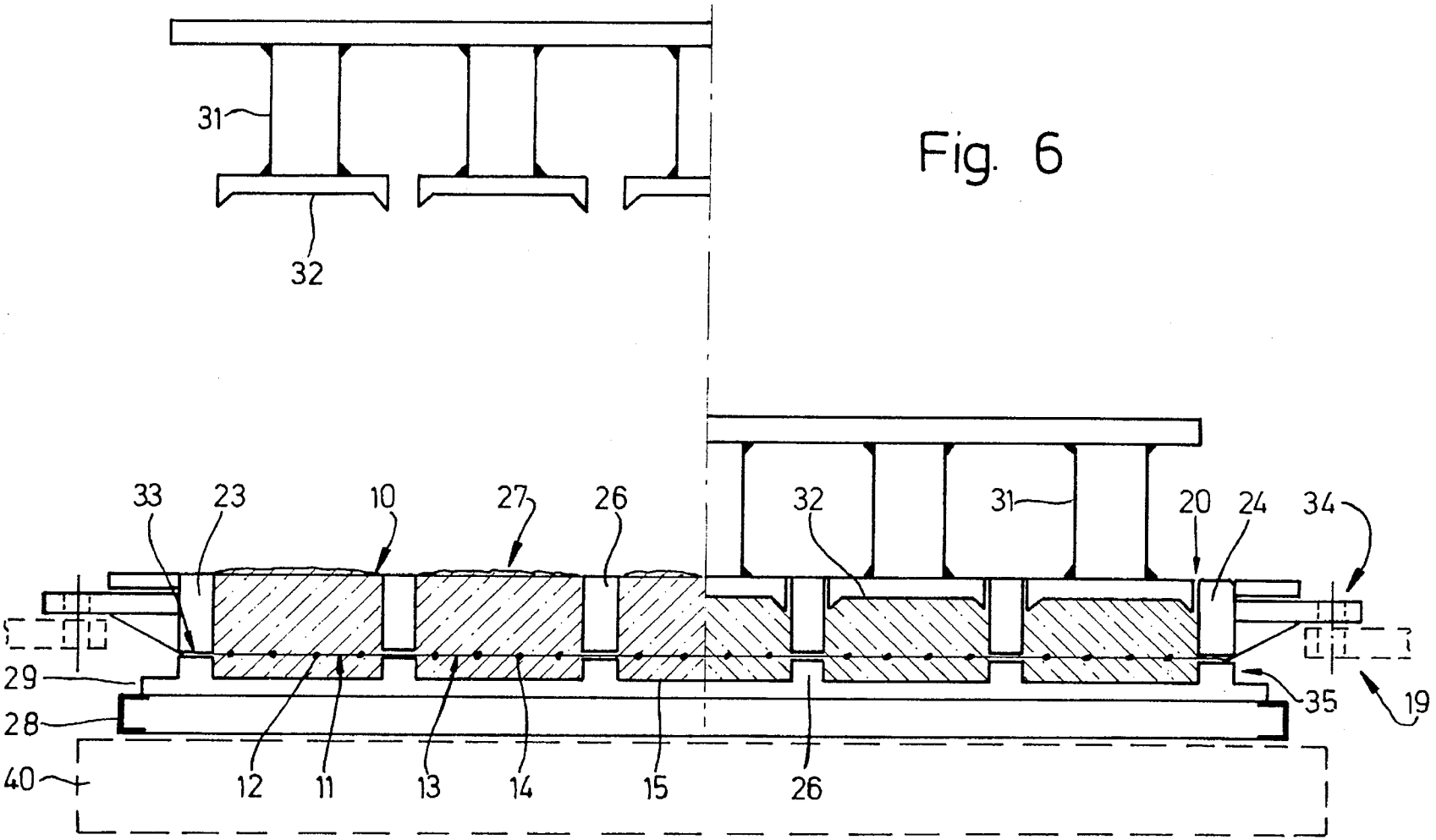
Figure 7:
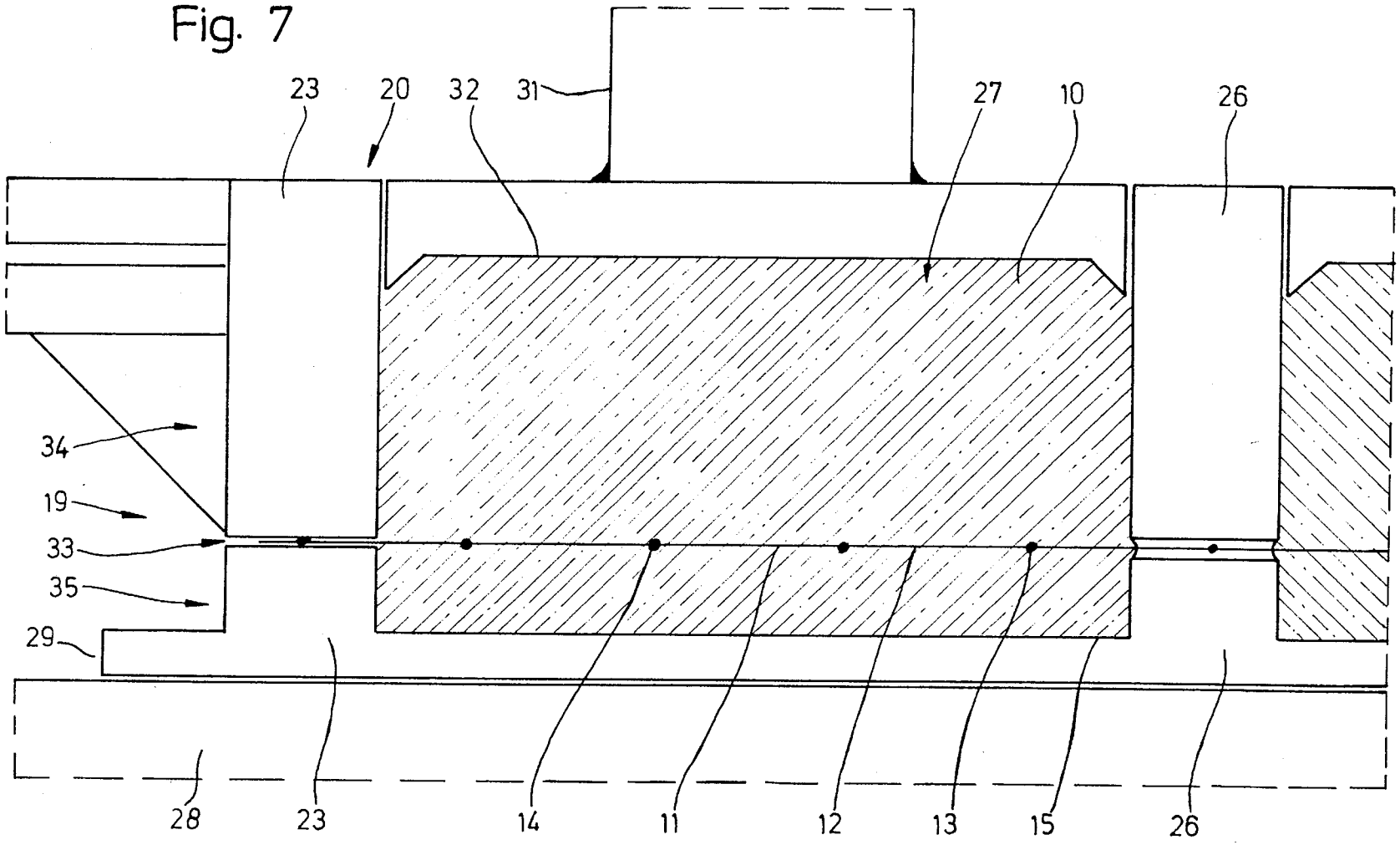
Figure 8:
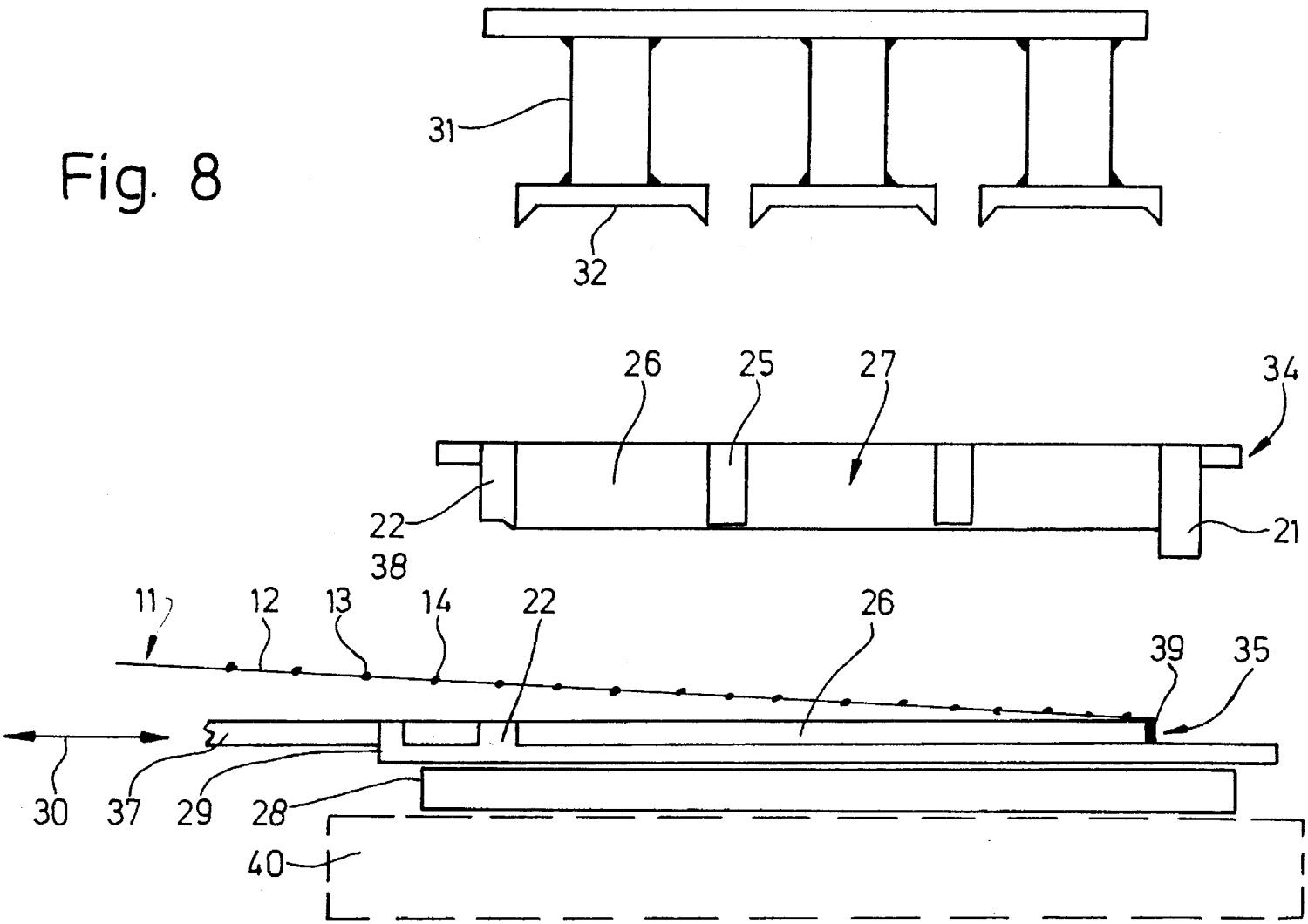

Further features of the invention relate to the manufacture of the paving stone set and to the configuration of the concrete mold. Details of the latter and of the paving stone set are explained in greater detail below with reference to the drawings, in which:

FIG. 1 shows a paving stone set or a part thereof in plan view,

FIG. 2 shows a section through the paving stone set according to FIG. 1 in the sectional plane II—II, FIG. 3 shows a section through the paving stone set according to FIG. 1 in the sectional plane III—III, FIG. 4 shows a concrete mold for the manufacture of paving stone sets according to FIG. 1 in top view, FIG. 5 shows the concrete mold according to FIG. 4 in cross-section, in part having the pressure ram raised, FIG. 6 shows the concrete mold in longitudinal section, in a representation corresponding to FIG. 5, FIG. 7 shows a detail of the concrete mold in longitudinal section, the scale having been heavily enlarged, FIG. 8 shows the individual parts of the concrete mold in a position in preparation for a production cycle, in side view.

The illustrative embodiments represented in the drawings relate, on the one hand, to a paving stone set as a laying unit for lawn paving. On the other hand, details of a device (concrete mold) for the production of such types of paving stone inserts are shown. The concrete mold can also be considered, however, for the production of paving stone sets which are not necessarily used as part of a lawn paving.

The paving stone set according to FIGS. 1 to 3 comprises (concrete) paving stones 10 arranged in longitudinal and transverse rows, having a square ground plan. The height of the paving stones 10 corresponds to the usual height of such paving stones corresponding to the expected load.

The paving stones 10 forming part of a laying unit or paving stone set are joined together by elastic members which are capable of bearing a tensile load, namely by a continuous holding grid 11. This comprises longitudinal strands 12 and transverse strands 13. The longitudinal strands 12 and transverse strands 13 are joined together in the region of nodes 14. The thus configured holding grid 11 consists of a suitable synthetic material, e.g. polyester. Holding grids 11 of this type can be continuously manufactured in corresponding continuous-casting machines. The material is weather-resistant and durable against tensile loads.

The holding grid 11 is embedded fully in the concrete of the paving stones 10, namely at an adequate distance from a bottom side 15 of the paving stones 10. In the illustrative embodiment shown, the holding grid 11 is at a distance from the bottom side 15, which distance corresponds to approximately one-third of the height of the paving stone 10.

For the use of a thus configured paving stone set (FIG. 1) for lawn paving blocks, the paving stones 10 are large distances apart, which distances are fixed by the holding grid 11. Wide longitudinal gaps 16 and equally wide transverse gaps 17 are thereby produced between the paving stones 10, which are arranged in rows. The longitudinal gaps 16 and transverse gaps 17 have a width of 4 cm to 5 cm. Within these longitudinal gaps 16 and transverse gaps 17, the holding grid 11 lies completely exposed. No spacers or connecting webs are provided. Due to the spacings between the longitudinal strands 12 and between the transverse strands 13, openings 18 or meshes of the holding grid 11 are produced which guarantee unhindered plant growth in the region of the longitudinal gaps 16 and transverse gaps 17. The spacing between the longitudinal strands 12 and between the transverse strands 13 here measures around 3 cm.

The laying units or paving stone sets configured in the described manner are produced in a conventional stone-molding machine by means of concrete molds exhibiting certain modifications compared to the conventional concrete molds.

A concrete mold usually comprises a flask 19. This comprises an outer frame 20 having longitudinal spars 21, 22 and transverse spars 23, 24. Running within this frame 20 are longitudinal walls 25 and transverse walls 26. These bound die cavities 27, in which the paving stones 10 are molded.

The frame 20, which is open at top and bottom, stands on a base, a molding plate 28. This can directly form the bottom extremity of the concrete mold. The finished paving stones rest on the molding plate 28 until fully set.

In the present illustrative embodiment, a drawing sheet 29 is provided as the bottom extremity of the flask 19. The drawing sheet 29 is consequently located between the flask 19 and molding plate 28. In the demolding operation, the drawing sheet 29 is withdrawn from the concrete mold, according to arrow 30, in the horizontal direction, so that the paving stones 10 then lie directly on the molding plate 28 and can be transported away with this once the flask 19 has been removed.

Pressure rams 31 having die plates 32 corresponding to the shape and size of the die cavities 27 enter into these from above.

In order to embed the holding grid 11 in the paving stones 10 during their manufacture, the flask 19, in the illustrative embodiment shown, is divided along an (imaginary) horizontal partition plane 33. A top part-flask 34 and a bottom part-flask 35 are thereby produced. Both together produce the whole flask 19.

In the region of the partition plane 33 there extends the holding grid 11. This is brought into position prior to the filling of the concrete. The fresh concrete, which has been filled into the open die cavities 27 from above, passes through the openings 18 or meshes in the holding grid 11, so that the flask 19 or each die cavity 27 is filled to the top with concrete.

The holding grid 11 is clamped or fixed between the part-flasks 34 and 35. In the present illustrative embodiment, the holding grid 11 is clamped on three sides only between the part-flasks 34, 35, namely in the region of the longitudinal spar 22 and transverse spars 23, 24.

The bottom part-flask 35 is configured such that the paving stones 10 can be demolded essentially according to the conventional principle. For this purpose, after the paving stones 10 in the individual die cavities 27 have been formed-out, the bottom part-flask 35 is initially removed. This is withdrawn from the region of the concrete mold, in the horizontal direction, according to arrow 30. In order to enable this, the bottom part-flask 35 comprises the bottom part of the longitudinal spar 22 of the (divided) frame 20, which bottom part is situated to the fore in the direction of draw according to arrow 30. The said frame is adjoined by transverse walls 26 running in the direction of the drawing motion or by bottom parts of these transverse walls 26. The bottom part-flask 35 consequently has no longitudinal walls 25. In this region, below the longitudinal walls 25 of the top part-flask 34, there are formed corresponding, elongated, strip-shaped cavities 41. These are infiltrated, in the manufacture of the paving stones 10, by some concrete, so that the finished paving stones 10 of a paving stone set exhibit, in the region of the longitudinal gaps 16, fins 36 adjacent to the bottom side 15. These fins 36 can be eliminated by a finishing operation. Since they only insubstantially reduce the cross-section of the longitudinal gaps 16, they can also however remain on the paving stones 10.

Following the withdrawal of the bottom part-flask 35, demolding can proceed in the usual manner. The pressure rams 31 remain in the pressure setting according to FIG. 7. The top part-flask 34 is moved upwards into a position according to FIG. 8. The pressure rams 31 are then raised. The molding plate 28, with the paving stones 10 and the holding grid 11 embedded therein, can now be transported away.

In the present illustrative embodiment, the bottom part-flask 35 is connected to the drawing sheet 29. The bottom parts of the transverse walls 26 are disposed as elongated edgings on the drawing sheet 29. To the said drawing sheet, there are fitted, on the one side, thrust rods 37, which enable, by means of a suitable actuating member (pressure-medium cylinder), a to-and-fro motion of the drawing sheet 29. By use of the drawing sheet 29, the bottom part-flask 35 is withdrawn from or introduced into the region of the concrete mold.

In the present case, the holding grid 11, which corresponds essentially to the size of a paving stone set, is drawn section by section from a roll (not shown). After a corresponding section of the holding grid 11 has been introduced into the concrete mold, the necessary piece is cut off. In the present illustrative embodiment, there is fitted to the top part-flask 34, namely to the longitudinal spar 22 situated to the fore in the direction of draw, a cutting edge 38, which realizes the separating cut as the part-flask 34 is lowered. The cutting edge 38 can also be disposed outside the region of the flask 19, at a distance therefrom, the holding grid 11 being cut off as it juts over the longitudinal spar 22 of the bottom part-flask 35. To the cutting edge 38, there is herein assigned a lower, fixed counter-blade, so that when the flask 19 is closed, the holding grid 11 is cut through and the longitudinal spars 22 of the top part-flask 34 and bottom part-flask 35 lie directly adjacent to each other and are thus able to clamp the holding grid 11.

In addition, the holding grid 11 is brought by the bottom part-flask 35 or by the drawing sheet 29 into the position within the flask 19. For this purpose, the front margin of the holding grid 11, which is in each case exposed, is fixed to a free margin of the drawing sheet 29 or of the bottom part-flask 35, e.g. to hook-shaped holding members 39.

From the original setting (not shown) of the drawing sheet 29 outside the concrete mold, the holding grid 11, as it is unwound from the roll, is transported into the concrete mold (FIG. 8). After this, the top part-flask 34 is lowered. The concrete is then filled into the die cavities 27, which are open at the top. The pressure rams 31 are thereafter lowered. The concrete is then compacted by a jarring table 40 on which the concrete mold rests.

Following the molding of the paving stones 10, the drawing sheet 29 is first retracted, in the described manner, with the bottom part-flask 35, then the top part-flask 34 moved upwards and the pressure ram subsequently raised.

The top part-flask 34 is configured such that the transverse walls 26 do not rest on the corresponding transverse walls 26 of the bottom part-flask 35. Rather, the top part-flask 34 is supported by the longitudinal spar 21, situated to the rear in the direction of draw, directly on the molding plate 28 or on the drawing sheet 29. Furthermore, the transverse spars 23, 24 of the top part-flask 34 rest on the corresponding transverse spars 23, 24 of the bottom part-flask 35. The longitudinal spar 22 of the top part-flask 34, which longitudinal spar is situated to the fore in the direction of draw, also rests on the longitudinal spar 22 of the bottom part-flask 35.

The paving stone sets which are thus manufactured can be mechanically laid in an advantageous manner. For this purpose, a laying machine according to German Offenlegungsschrift 34 11 350 exhibits a head for gripping a respective paving stone set. The head comprises two clamping jaws running in the transverse direction, which press the paving stones 10 together during the laying operation. In order to secure the gap spacings between the paving stones 10 in the longitudinal direction, it is necessary for the head to be provided with spacers, which engage in the longitudinal gaps 16 and fix the paving stones 10, during laying, at corresponding distances apart.

The described concrete mold is also suitable for the manufacture of paving stone sets or laying units which are not intended for lawn paving blocks, but which nevertheless exhibit a fully embedded holding grid. The gaps are in this case smaller or narrower.

I claim:

1. A paving stone set made up of a region of concrete paving stones (10) which are spaced apart to create a region of longitudinal gaps (16) and transverse gaps (17), wherein the concrete paving stones are joined together by a holding grid (11) and are secured against displacement, and wherein:

a) said concrete paving stones (10) are joined together exclusively by said holding grid (11);

b) said holding grid (11) consists of tension-resistant and non-perishable elastic material;

c) said holding grid (11) lies continually exposed in said region of said longitudinal gaps (16) and transverse gaps (17);

d) said holding grid (11) is fully embedded in said concrete paving stones (10) exclusively in said region thereof;

e) said holding grid (11) is embedded in said concrete paving stones (10) at a distance from a bottom side (15) of said concrete paving stones (10), which distance corresponds to one-quarter to one-third of the total height of one of said concrete paving stones (10); and f) said holding grid (11) comprises spaced-apart longitudinal strands (12) and spaced apart transverse strands (13), the spacing between the longitudinal strands (12) and between the transverse strands (13) measuring 2 cm to 5 cm.

2. The paving stone set as claimed in claim 1, wherein said spacing is approximately 3 cm.

3. A process for manufacture of paving stone sets made up of concrete paving stone (10) which are spaced apart and joined together by a holding grid (11) formed from longitudinal strands (12) and transverse strands (13), said process being implemented in a concrete mold having a flask (19) which is provided with die cavities (27) for one concrete paving stone (10) each, and having a base molding plate (28) which limits a bottom of the flask (19), said process comprising the steps of:

a) positioning a bottom pan-flask (35) on the base molding plate (28);

b) thereafter, spreading out the holding grid (11) on the bottom pan-flask (35);

c) thereafter, depositing a top part-flask (34) on the bottom part-flask (35) or on the holding grid (11), the holding grid (11) being clamped between the top part-flask (34) and the bottom part-flask (35) in a region of three sides;

d) thereafter, filling fresh concrete into an open top of the flask (19), the holding grid (11) being configured such that the concrete is able to pass through openings (18) formed by the longitudinal strands (12) and transverse strands (13);

e) thereafter, lowering pressure rams (31) into the flask (19) from above to compress the concrete;

f) thereafter, horizontally retracting the bottom part-flask (35) relative to the stationary top part-flask (34), g) thereafter, moving the top part-flask (34) upwards; and h) finally, raising the pressure rams (31).

* * * * *